US005904017A

United States Patent [19]

Glatz et al.

[11] Patent Number: 5,904,017

[45] Date of Patent: May 18, 1999

[54] PHOTOLUMINESCENT EMERGENCY EGRESS ACCESSORY

[75] Inventors: Jerald L. Glatz, Garrettsville, Ohio; William C. Martin, LaCrescenta, Calif.

[73] Assignee: Duramax, Inc., Middlefield, Ohio

[21] Appl. No.: 08/649,820

[22] Filed: May 17, 1996

[51] Int. Cl.[6] ..... E04F 19/04

[52] U.S. Cl. ..... 52/287.1; 428/67; 428/192; 428/690; 428/913; 52/179; 250/462.1

[58] Field of Search ..... 428/119, 690, 428/913, 192, 67; 250/462.1, 463.1; 52/179, 181, 288.1, 287.1

[56] References Cited

U.S. PATENT DOCUMENTS

| | | | |
|---|---|---|---|
| 1,467,132 | 9/1923 | Bilstein | 250/462.1 |
| 2,155,449 | 4/1939 | Seaman | 250/72 |
| 2,169,657 | 8/1939 | Millson | 139/420 |
| 2,360,516 | 10/1944 | Schmidling | 250/80 |
| 2,387,512 | 10/1945 | Hilberg | 250/462.1 |
| 2,981,858 | 4/1961 | O'Connell | 313/108 |
| 3,273,296 | 9/1966 | Soulon | 52/288.1 |
| 4,058,942 | 11/1977 | Naka | 428/67 |
| 4,385,586 | 5/1983 | Schriever . | |
| 4,401,050 | 8/1983 | Britt et al. . | |
| 4,522,861 | 6/1985 | Dunsworth | 428/192 |
| 4,801,928 | 1/1989 | Minter . | |
| 4,913,946 | 4/1990 | Sala . | |
| 4,998,391 | 3/1991 | Connew | 52/179 |
| 5,027,741 | 7/1991 | Smith et al. . | |
| 5,212,923 | 5/1993 | Pelosi et al. | 52/288.1 |
| 5,300,783 | 4/1994 | Spencer et al. | 250/462.1 |

OTHER PUBLICATIONS

In Re James Mason, 141 USPQ 521.

*Primary Examiner*—Alexander Thomas
*Attorney, Agent, or Firm*—D. Peter Hochberg

[57] ABSTRACT

A photoluminescent safety accessory for attachment to walls, floors, stairs, handrails, ceilings or the like located along emergency egress routes. The accessory is comprised of a nonluminescent material and a photoluminescent material integrally formed with and molecularly bonded to the nonluminescent material, the luminous material becoming illuminated upon the extinguishing of the ambient light. A coextrusion system for integrally extruding the photoluminescent safety accessory is also disclosed.

2 Claims, 4 Drawing Sheets

PHOTOLUMINESCENT EMERGENCY EGRESS ACCESSORY

The present invention relates generally to an accessory including a photoluminescent strip to identify escape routes during emergencies. More particularly, the present invention relates to an accessory including a photoluminescent strip coextruded with, or otherwise attached to, a nonluminescent material to form an integral product. The accessory is attachable to floors, walls, stairs or other fixtures normally found in an office building, an institution, a factory or other buildings used by people.

BACKGROUND OF THE INVENTION

Many buildings contain egress routes which can be immersed in darkness in the event of a fire or other emergency. In such a situation, individuals cannot locate the building exits because escape routes and emergency exits are no longer visible.

It has therefore been known and is desirable to provide buildings with illumination systems which identify escape routes in the event of an emergency. There are two general classes of systems available. The first is electrically-operated systems. These normally consist of a series of emergency lights powered by an emergency generator or by batteries. The second is photoluminescent systems. These normally consist of photoluminescent products placed on the walls, floors, stairwells and/or around the door frames of escape routes.

Some drawbacks of electrical systems are their expense and the fact that they require a power source, which can fail during an emergency. Furthermore, because of their expense they are typically only used at specific points along an escape route rather than along the entire route. Moreover, they are not continuous.

Another problem with existing systems is that they are usually located high on walls or on the floor. It would be advantageous if warning systems could have a low location on the walls, since people often drop to the floor in the case of fire or the like.

Photoluminescent materials are less expensive than the aforementioned electrical products or systems; therefore, they are economical enough to be used along, and therefore illuminate, the entire escape route. Such materials are easy to install and are relatively maintenance free. These materials contain a photolurninescent component which absorbs and stores sunlight and/or artificial light. The materials become photoluminescent, i.e. they glow in darkness, thereby identifying escape routes. One problem with many photoluminescent materials is that they are applied on-site to walls or floors. This creates considerable labor expense. Furthermore, the materials can wear off or be torn loose. Examples of such materials are photoluminescent tapes, paints and other products which are applied in a secondary process.

The expense of on-site application is eliminated if the photoluminescent materials are combined with a nonluminescent product in a factory and the combined product is installed on the egress route. In this case, the photoluminescent component, usually photoluminescent tape, is applied to another product, such as a molding, floor tile, stair tread or wall panel, in a secondary combining operation. The labor required to combine the photoluminescent component with the nonluminescent product, however, still adds considerable cost because a separate manufacturing step, i.e. the application of the photoluminescent material, must be undertaken. Additionally, the photoluminescent component can still wear off or be torn loose after the product has been installed.

It has been known to make photoluminescent vinyl sheet goods and tiles utilizing the calendaring method. This eliminates the step of applying photoluminescent tapes or coatings to the products in a secondary process. The molded products disclosed in the prior art, however, are not provided, nor could they be easily manufactured, in continuous strips. Additionally, the prior art discloses only molded products which are formed entirely from photoluminescent material. Also, the prior tiles are laminated, and the photoluminescence does not extend through the tile to its back. No products comprised of an integral combination of photoluminescent and nonluminescent materials are disclosed.

U.S. Pat. No. 4,801,928 shows an egress detection system including at least three electroluminescent lamps in a linear arrangement and circuitry for sequentially illuminating the lamps. Each lamp contains two sets of indicators in the form of arrows pointing in opposite directions. The arrows pointing toward one exit are illuminated in the case of one sensed danger and the arrows pointing in the opposite direction are illuminated in response to a second sensed danger.

U.S. Pat. No. 4,401,050 discloses a continuous adhesive transparent sheet having discontinuous phosphorescent arrows or other indicia protruding therefrom. The indicia is either formed within or attached to the adhesive sheet. If the indicia is formed within the sheet, the phosphorescent material is added in a secondary combining operation.

U.S. Pat. No. 4,385,586 discloses a path-marking system employing a series of photoluminescent accessories. Each individual accessory has tactile characteristics of shape and surface contacts which, in combination, indicate direction and distance to the nearest evacuation exit.

U.S. Pat. No. 2,169,657 discloses a woven floor covering made with yarn dyed with rhodamine, a substance which fluoresces when exposed to ultraviolet light. Another embodiment discloses a woven floor covering printed with fluorescent or ultraviolet light-sensitive pigments. In another embodiment, a floor covering is painted with fluorescent paint.

U.S. Pat. No. 2,387,512 discloses a photoluminescent adhesive tape. The tape is provided with a layer of photoluminescent pigment which is protected from the atmosphere by a transparent film which does not interfere with the activation of the photoluminescent pigment on exposure to light.

The present invention improves upon the teachings of the prior art by providing a product comprised of a continuous strip of nonluminescent material coextruded with photoluminescent material to form an integral product in which the two materials are molecularly bonded.

SUMMARY OF THE INVENTION

In accordance with the present invention, there is provided an accessory comprised of a nonluminescent material and a photoluminescent material which are preferably coextruded and molecularly bonded to form an integral product.

It is an object of the present invention to provide an accessory including photoluminescent material which identifies escape routes in the absence of light, such as during power outages.

Another object of the present invention is to provide an accessory as described above which can be formed as wall bases, knob inserts for round raised disk tiles, stair tread covers, cove mouldings, base mouldings, corner bumper guards, cove caps, stair nosings, signs, signage and path markers, light switch covers, carpet cove caps, tactile warning strips, guidance strips or other products like the foregoing.

Another object of the present invention is to provide an accessory wherein the nonluminescent material and the photoluminescent material are comprised of extrudable plastics.

Another object of the present invention is to provide an accessory as described above wherein the photoluminescent material forms a continuous visible strip on a surface of the accessory when the accessory is installed.

Another object of the present invention is to provide an accessory as described above wherein the photoluminescent material contains zinc sulfide particles.

Another object of the present invention is to provide an accessory as described above wherein the photolurninescent material is at least 0.070 inch (1.7 mm) thick.

Another object of the present invention is to provide a photoluminescent safety accessory which is simple and economical in design.

A further object is to provide a photoluminescent accessory which can be located low on a wall to enable it to be seen in darkness by a person crawling along a floor during an emergency.

Additional objects, features and advantages will be apparent in the written description which follows and from the appended claims.

BRIEF DESCRIPTION OF THE DRAWINGS

The invention may take form in certain parts and arrangement of parts, a preferred embodiment of which will be described in detail in the specification and illustrated in the accompanying drawings wherein.

DETAILED DESCRIPTION OF A PREFERRED EMBODIMENT

Figure 1:
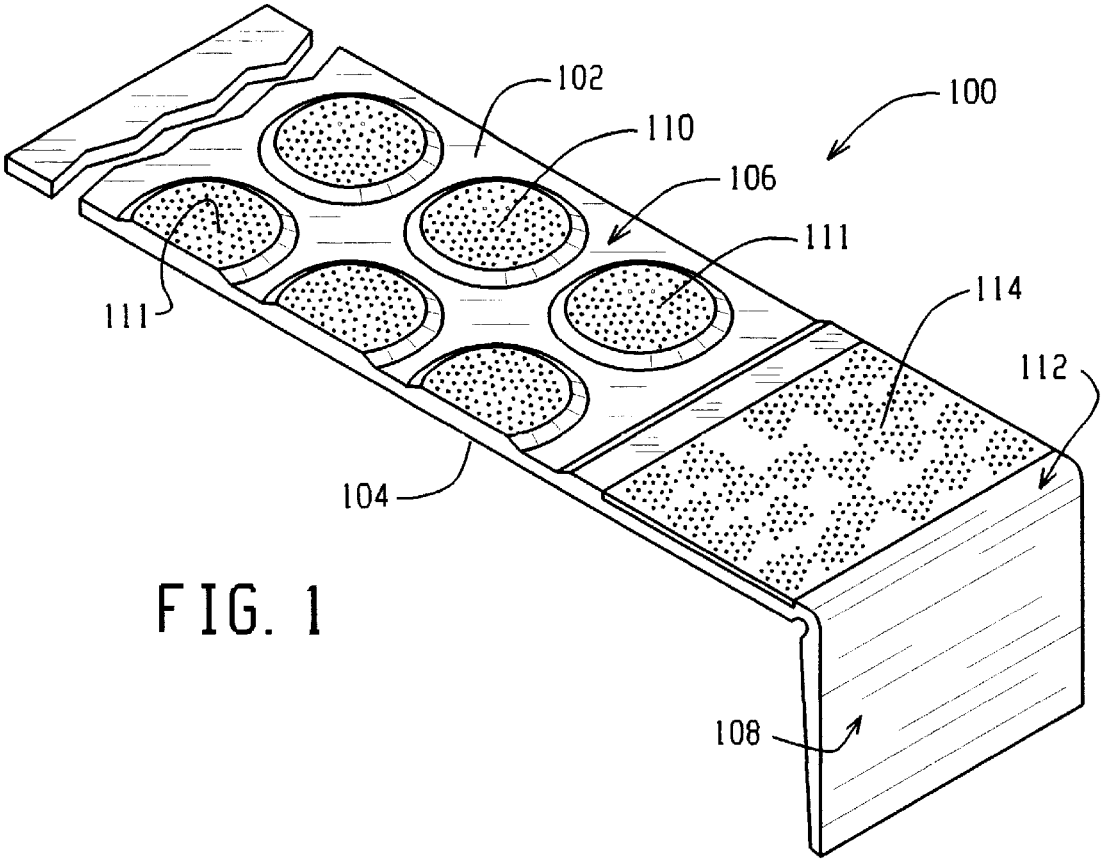
FIG. 1 is a side perspective view of a stair tread in accordance with the present invention.

The invention includes flooring, wall, stair and walkway accessories for use in areas which become dark intermittently or during emergency situations. The invention is comprised of a nonluminescent material and a photoluminescent material, preferably coextruded and molecularly bonded, to create a single, integrally-formed product. The respective compositions of the nonluminescent material and the photoluminescent material are not critical to the teaching of the invention. In a preferred embodiment, however, the nonluminescent material and photoluminescent material are chosen so that they molecularly bond to one another during the extrusion process to create an integral product. This eliminates the need for secondary bonding agents such as adhesives. It also eliminates the labor required for a secondary combining step where adhesive is used to join the photoluminescent material to the nonluminescent material. Preferably, the materials may be one of various plastic compounds such as polyethylene, polypropylene, polystyrene, polyvinyl chloride or ABS. Rubber may also be used.

The preferred forming process is plastic, molding or extrusion. The processing of photoluminescent plastic compounds can be accomplished by plunger-type injection molding machines or single screw extruders which treat the photoluminescent pigment gently. Processing temperatures,, injection speeds or extrusion speeds should conform to manufacturer's specifications.

The photoluminescent material includes photoluminescent pigment. In a preferred embodiment, the photoluminescent pigment is a high-temperature processed crystalline zinc sulfide. Zinc-sulfide based pigments glow green-yellow. This largely matches the spectral sensitivity of the eyes, therefore, the pigments are capable of high luminescence intensity and are especially well-suited for marking and identification purposes. Zinc sulfide pigments are capable of absorbing ambient UV-light, daylight or artificial light, store the light energy and discharge it over an extended period of time. Additionally, these pigments are not radioactive and are nontoxic. The thickness of the photoluminescent layer should be at least 0.070–0.100 inch (1.7–2.5 mm). If a white background is used in conjunction with the photoluminescent layer, the photoluminescent effect is intensified through reflection.

In the preferred embodiment, the pigment has a minimum photometric requirement of 28/3.4-430 W-K when tested in accordance with European test method DIN 67510, part 1. The heavy metal content is in compliance with BGA A-1X limit values when tested in accordance with European test method DIN 53770.

Other general requirements of the photoluminescent material used in the invention are as follows:

| Properties | Requirements | Tests |
|---|---|---|
| Photometric Properties | Minimum 15/1.6 - 220 - W - K<br>Minimum 10/1.2 - 180 - W - K | DIN 67 510 part 1<br>DIN 67 510 part 2 |
| Flammability | Class B 2 | DIN 4102 part 4 |
| Resistance to Aging | No decline of photometric properties | DIN 53 387 - 2 - E 500 hrs. |
| Resistance to Salt Spray Mist | No visible changes after 120 hrs. | DIN 50021-SS |
| Resistance to Chemical Influences | DIN 53 521/11.87, paragraph 8.11; no visible changes | DIN 74 069/05.89, paragraph 6.2.3 |
| Resistance to Water and Cleaning agents | No changes | DIN 30 646 part 1/ 08.89, paragraph 4.7; ID symbol L |

The major benefit of the invention as disclosed herein is that it has superior brightness of photoluminescent properties as compared with other products. A noticeable drop of luminance during the first 30 minutes of darkness is common to all photoluminescent materials. The products described herein, however, have shown a lower decline in brightness than other products during the first 30 minutes. Furthermore, the products described herein are visible for up to 8–10 hours of darkness.

Turning now to the drawings where the purpose is for showing a preferred embodiment of the present invention, and not for limiting same FIG. 1 shows a stair tread cover 100 made in accordance with the present invention. Stair tread cover 100 is formed from a molded nonluminescent material with a photoluminescent material, such as photoluminescent tape, adhered thereto, to create an integral product.

Tread cover 100 has an exterior surface 102 and an interior surface 104. Tread cover 100 includes a tread portion 106 for extending across a stair, and a nose portion 108 formed perpendicular to portion 106. Tread portion 106 has an area with slightly elevated areas, such as raised circles 110 to prevent people from slipping when stepping on tread cover 100. Knob inserts 111 made of photoluminescent material are provided in some of the raised circular areas. Interior surface 104 is generally smooth and planar so that it may conform with the surface of the metal, concrete, or wood stair tread upon which tread cover 100 rests. Nose portion 108 extends downward, resting against the stair riser when tread cover 100 is installed. Nose portion 108 has a juncture 112 formed with tread portion 106. A strip of photoluminescent material 114, which can be on the surface of a tape attached to tread portion 106 or formed integrally therewith, is provided near nose juncture 112. Strip 114 could be on juncture 112, nose portion 108 or on two or more parts of tread cover 100. Strip 114 can extend from nose portion 108 onto the horizontal part of exterior surface 102 adjacent juncture 112 and a separate photoluminescent strip parallel to juncture 112 on the horizontal part of cover 100 can also be provided. Knob insert 111 and strip 114 become luminous and is visible along the egress route when the ambient light is extinguished. Usually, only one of the knob inserts 111 or strip 114 would be used, rather than both of these materials.

Figure 2:
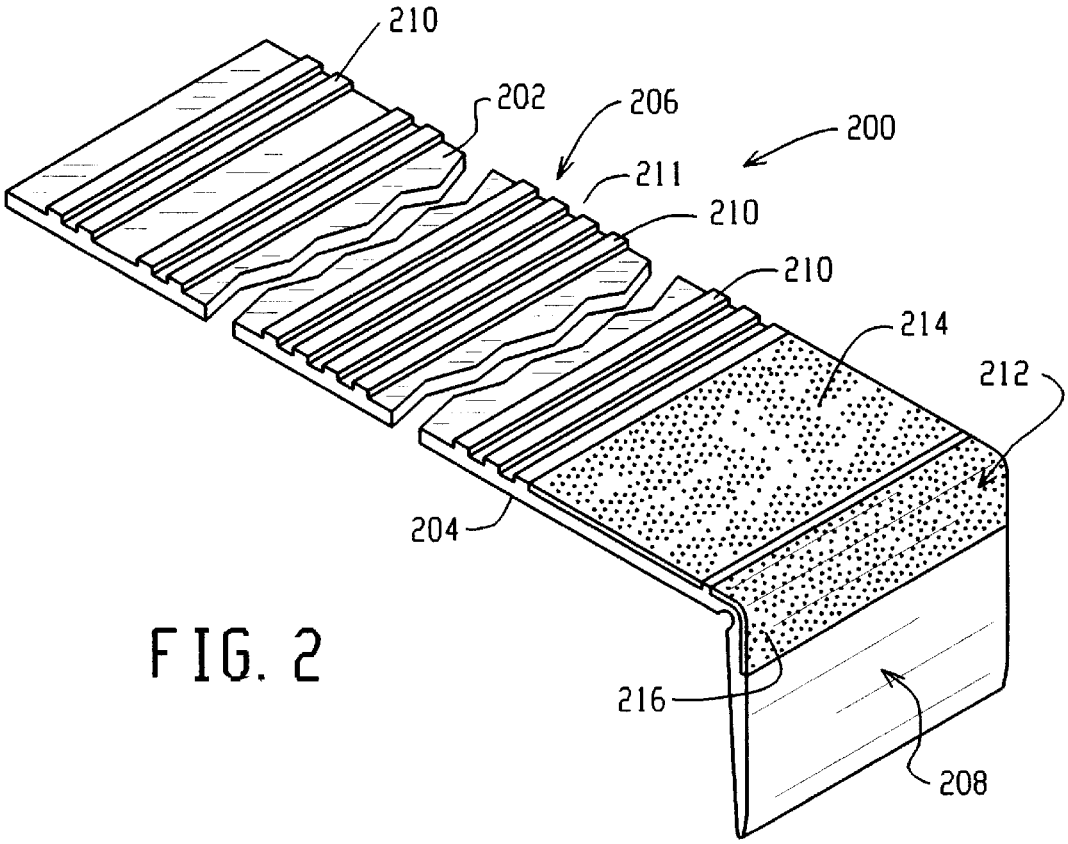
FIG. 2 is a side perspective view of a heavy-duty stair tread with stair nosing in accordance with the present invention.

Turing now to FIG. 2, heavy-duty stair tread cover 200 is shown. Stair tread cover 200 is formed from a nonluminescent material coextruded with a photoluminescent material to create an integral product. Tread cover 200 has an exterior side 202, an interior side 204, a tread portion 206 and a nose portion 208 formed perpendicular thereto, which meet at a nose-tread juncture 212. Tread portion 206 is composed of a series of lateral treads 210, which can be sets 211 of treads. Treads 210 engage shoes or boots to increase traction and help prevent slipping. On the part of the tread portion near juncture 212 is a photoluminescent strip 214, which can be on the surface of a tape secured to tread portion 206 or coextruded therewith. Another photoluminescent strip 216 is provided on juncture 212. The interior side 204 has a rough or sanded finish to enable tread cover 200 to be glued or otherwise firmly engage the surface of the metal, concrete or wood stair tread to which tread 200 will be applied. Portions 214 and 216 become luminous and are visible along the egress route when the ambient light is extinguished.

Figure 3:
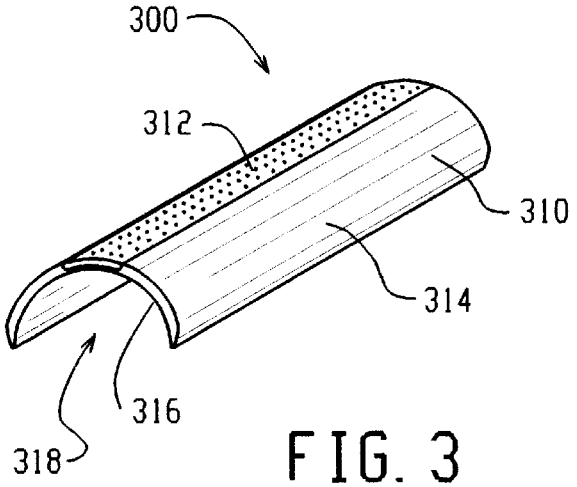
FIG. 3 is a side perspective view of a handrail cover.

Turning now to FIG. 3, a handrail cover 300 is shown. Handrail cover 300 is comprised of a nonluminescent portion 310 coextruded with a photoluminescent portion 312 to form an integral product. Cover 300 includes a smooth radiused exterior surface 314 and an interior surface 316. Handrail cover 300 has a generally semi-cylindrical configuration, and photoluminescent portion is radiused as well and forms part of the semi-cylinder. Handrail cover 300 is curved about a longitudinal axis and forms a cavity 318, which can fit around a handrail to which cover 300 can be mechanically or adhesively attached. Cover 300 is resilient, and can fit on handrails having a range of radiuses. Photolumninescent portion 312 becomes luminous and is visible along the egress route when the ambient light is extinguished.

Figure 4:
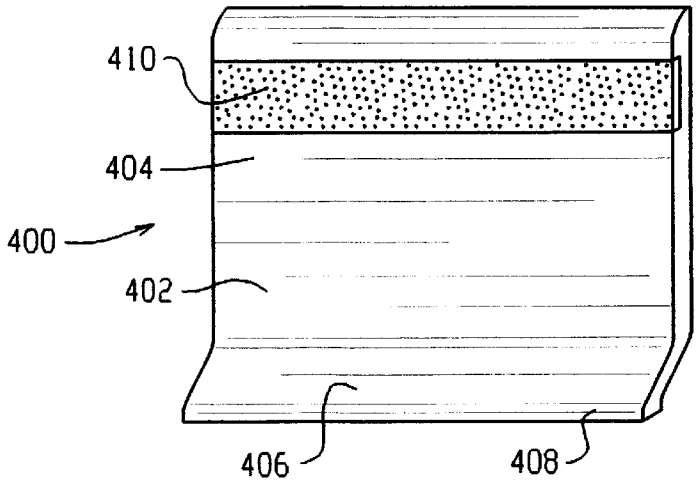
FIG. 4 is a front perspective view of a wall base in accordance with the present invention.

Turning now to FIG. 4, a wall base 400 is shown. Wall base 400 is integrally formed from a nonluminescent material coextruded with a photoluminescent material. Wall base 400 has a smooth continuous exterior surface 402 comprising a generally flat, planar upper portion 404 and a flared lower portion 406. Lower portion 406 extends outward from upper portion 404. A lip 408 extends along the bottom of lower portion 406 forming the lower edge thereof. A photoluminescent strip 410 is continuously formed along exterior surface 402 at or as shown in FIG. 4, above the junction of upper portion 404 and lower portion 406. Photoluminescent strip 410 becomes luminous and is visible along the egress route when the ambient light is extinguished. Wall base 400 is particularly useful since it is located low on the wall near the floor, and can easily be seen by persons who have dropped to the floor during a fire or other emergency.

Figure 5:
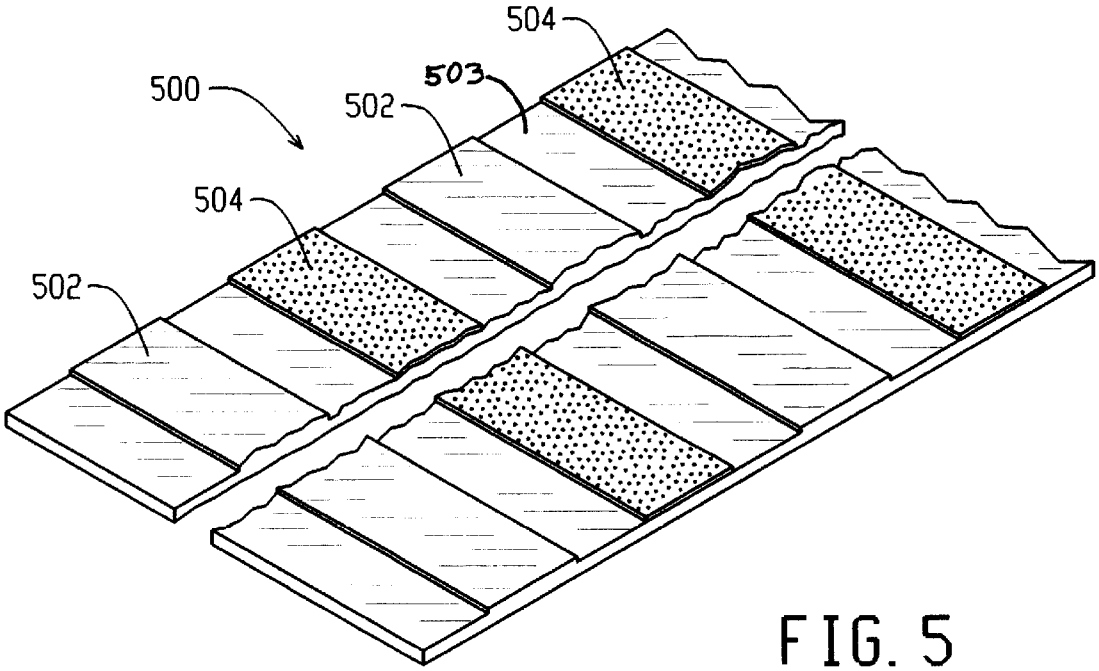
FIG. 5 is a sectional top perspective view of a tactile warning strip in accordance with the present invention.

Referring to FIG. 5, a tactile warning strip 500 is shown. As is known to those skilled in the art, tactile warning strips are placed at the top of stairways, rail platforms or other areas to alert the visually impaired to danger of a fall. Tactile warning strip 500 is a generally flat member, preferably having a vinyl or rubber body portion, with laterally extending raised vinyl or rubber treads 502, and photoluminescent treads 504. Treads 504 are preferably integral with the body of strip 500, as are treads 502, and can be commonly extruded with the extrusion of strip 500. A set of grooves 503 extend in parallel between treads 502 and 504; the difference in heights between grooves 503 and treads 502, 504 provide the tactile warning. Photoluminescent strip 504 becomes luminous and is visible along the egress route at the top of stairs, platforms or wherever it is placed, when the ambient light is extinguished.

Figure 6:
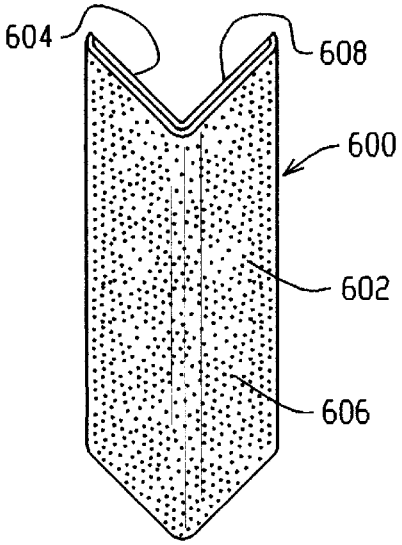
FIG. 6 is a front perspective view of a wall corner bumper guard in accordance with the present invention.

Considering FIG. 6, a corner bumper guard 600 is shown. Guard 600 has a front surface 602 and an interior surface 604. The interior of guard 600 is preferably extruded vinyl, and the front of guard 600 is a photoluminescent strip 606. Photoluminescent strip 606 is preferably continuously coextruded with the nonluminescent material 608 forming the interior of bumper guard 600 to form an integral product. Photoluminescent strip 606 becomes luminous and is visible along the egress route when the ambient light is extinguished to warn of the presence of a corner of the wall to which guard 600 is attached.

Figure 7:
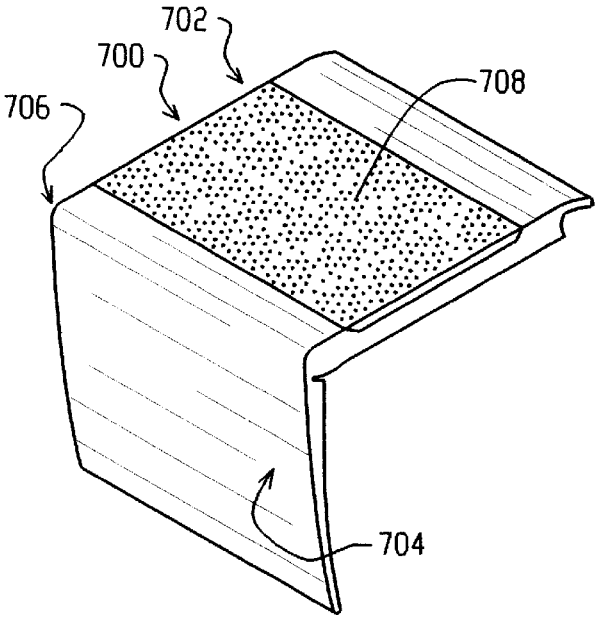
FIG. 7 is a side perspective view of a stair nosing in accordance with the present invention.

Turning now to FIG. 7, a stair nosing 700 is shown. Nosing 700 is formed by coextruding a nonluminescent material with a photoluminescent material to form an integral product. Nosing 700 has a tread portion 702 and a generally flat riser portion 704 formed at a right angle to tread portion 702, with portions 702 and 704 being connected at a nose portion 706. A photoluminescent strip 708 is formed in tread portion 702, and is preferably coextruded with the other parts of nosing 700. Photoluminescent strip 708 becomes luminous and is visible along the egress route when the ambient light is extinguished, to indicate the location of stairs to which stair nosing 700 is attached.

Figure 8:
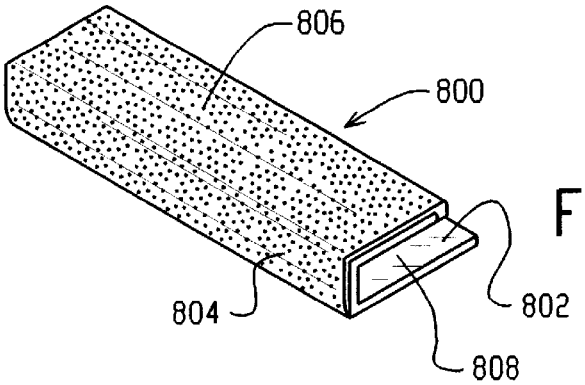
FIG. 8 is a perspective view of a carpet cove cap in accordance with the present invention.

Turning now to FIG. 8, a carpet cove cap 800 is shown. As is known in the art, a cove cap is a generally three-sided structure into the open face of which the edge of a carpet, rug, or vinyl sheet material is inserted. The cove cap protects the edge of the carpet, rug, or vinyl sheet material and creates a neat sight line along the edge of a wall. Cap 800 is formed of three generally flat, planar sections 802, 804 and 806. Sections 802 and 806 are generally parallel to each other, section 802 being wider than section 806. Section 804 is perpendicular to parallel sections 802 and 806 and joins the ends of the foregoing sections to form a cavity 808 for receiving the edge portion of a carpet, rug or of vinyl sheet material (in which case the cavity would be thinner). A carpet or rug cavity would usually be ¼ inch in height, whereas a cavity for a vinyl sheet would usually have a height of ⅛ inch. The entire cove cap is made of a photoluminescent material. Photoluminescent cap 800 becomes luminous and is visible along the egress route when the ambient light is extinguished.

Figure 9:
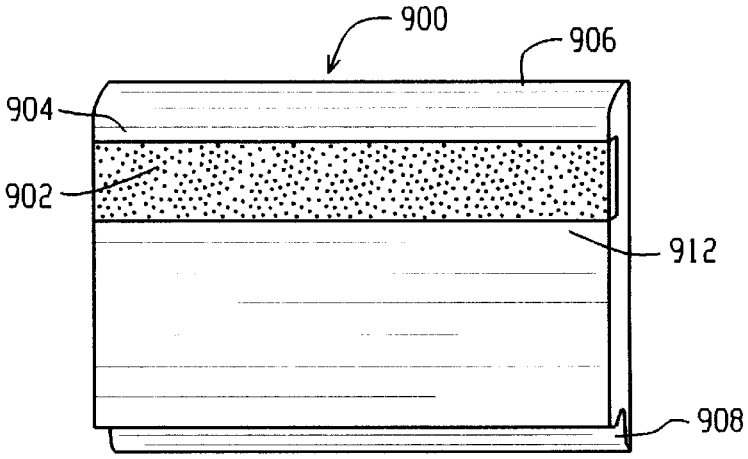
FIG. 9 is a side perspective view of a wall cove base in accordance with the present invention.

FIG. 9 shows a wall cove base 900 which is the subject of U.S. Pat. No. 5,212,923. In the embodiment shown, the gauge cove base 900 is formed of a nonluminescent material coextruded with a photoluminescent strip 902 to form an integral product. Cove base 900 has an upper portion 904. Upper portion 904 tapers into a curved edge 906 for engagement with a wall. The bottom of cove base 900 is undercut to form a cove 908. Photoluminescent strip 902 is continuously formed into an exterior wall 912. Photoluminescent strip 902 becomes luminous and is visible along the egress route when the ambient light is extinguished.

Figure 10:
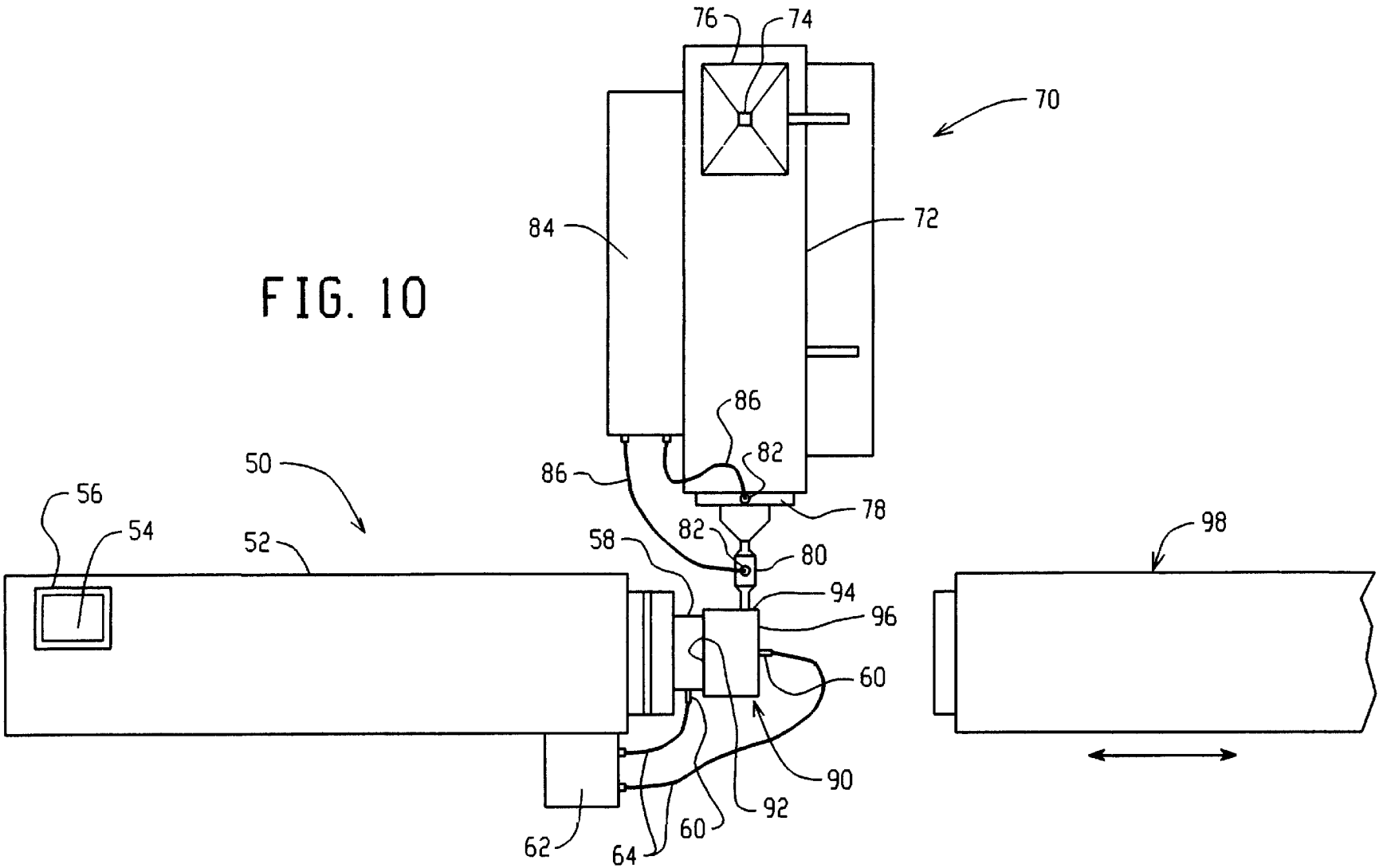
FIG. 10 is a schematic view of the machinery used in a preferred embodiment of a process to manufacture products in accordance with the present invention.

Referring next to FIG. 10, a preferred process for manufacturing the present invention is shown. The manufacturing equipment used in the preferred process includes a main extruder 50, a secondary extruder 70, an extrusion die 90 and a cooling tank 98.

Main extruder 50 has a body 52 housing an interior cavity (not shown). An opening 54 in body 52 is located near the rear of extruder 50. A bin 56 is provided within opening 54 and extends upward therefrom. An extruder head 58 is located at the front of extruder 50, opposite opening 54. Thermocouples 60 are connected to a controller 62 by wire leads 64. Control panel 62 thereby monitors and maintains the temperature in extruder head 58 and extrusion die 90. Heating means (not shown) heat the interior cavity of extruder 50 and a screw (not shown) extends longitudinally through body 52.

Secondary extruder 70 has a body 72 housing an interior cavity (not shown). An opening 74 in body 72 is located near the rear of extruder 70. A bin 76 is provided within opening 74. Bin 76 has four planar sides extending upward and outward from opening 74 to create a funnel effect. An extruder head 78 is provided at the front end of the extruder 70, opposite opening 74. An extruder head extension 80 has an end which is mounted to extruder head 78 and an end which is inserted into extrusion die 90. Thermocouples 82 are connected to a control/heating means 84 by wires 86. Control/heating means 84 thereby monitors and maintains the temperature in extruder head 78 and extruder head extension 80. A screw (not shown) extends longitudinally through body 72.

An extrusion die 90 is mounted on extruder head 58 of main extruder 50. Extrusion die 90 has a side 92 having input ports (not shown) mounted against extruder head 58 and a side 94 having input ports (not shown) which are perpendicular to side 92 and which communicate with extruder head extension 80. Output side 96 is opposite to and generally parallel to side 92. The profile of the product to be extruded is formed in side 96.

Turning now to the manufacture of the present invention, the preferred process of manufacture is coextrusion. Nonluminescent plastic or rubber resin is placed in bin 56 and enters the interior cavity of extruder body 52 through opening 54. In a preferred embodiment, bin 56 is continuously supplied with nonluminescent resin to allow for a continuous manufacturing process. An electric power source (not shown) powers the heating means and the screw, causing the heating means to heat the interior cavity of extruder S0 and causing the screw to turn.

As nonluminescent resin enters the inner cavity of extruder 50, the screw turns and pushes the resin forward. Heat is transferred to the resin causing it to melt into a liquid or semi-liquid plastic. The liquid or semi-liquid plastic is eventually pushed into the extruder head 58 and into the input ports in side 92 of extrusion die 90.

Photoluminescent resin material, which in a preferred embodiment is transparent resin mixed with zinc sulfide particles, is supplied in bin 76 of secondary extruder 70. Photoluminescent resin enters the interior cavity of extruder body 72 through opening 74. In a preferred embodiment, bin 76 is continuously supplied with nonluminescent resin to allow for a continuous manufacturing process. An electrical power source (not shown) powers the control/heating means 84 and the screw, causing control/heating means 84 to heat the interior cavity of extruder 70 and causing the screw to turn.

As photoluminescent resin enters the interior cavity of extruder 70, the screw turns and pushes the resin forward. Heat is transferred to the resin causing it to melt into a liquid or semi-liquid plastic. The liquid or semi-liquid plastic is eventually pushed into extruder head 78, through extruder head extension 80 and into the input port in side 94 of extrusion die 90.

The nonluminescent liquid or semi-liquid plastic and the luminescent liquid or semi-liquid plastic are combined and molecularly bonded within extrusion die 90. An integral product comprised of the nonluminescent material and the luminescent material is extruded from the output port in side 96 of die 90. The integral product passes into cooling tank 98 where it is cooled. Eventually the product is cut into linear lengths or coiled on cores and packaged in operations not shown.

Modifications and alterations to the products heretofore described will occur to others upon a reading and understanding of the present invention. For example, the photoluminescent portion of an article of manufacture in accordance with the present invention may be narrower or wider than is shown in the preferred embodiments described above. In this respect, an entire exterior surface of a member may consist of photoluminescent material. Additionally, the photoluminescent material does not have to be of a continuous width or thickness. It is only required that photoluminescent material be integrally formed into the accessory where it will be visible along the egress route.

What is claimed is:

1. A wall base comprising:

a non-luminescent upper portion having a predetermined height, a flat back surface for engaging the lower base of a wall, a flat front surface generally parallel to said back surface and a curved surface connecting the upper portions of said back surface and said front surface;

a non-luminescent flared lower portion integral with said upper portion and extending forwardly outward from said upper portion, said lower portion having a lip on the forward part of said lower portion, said lip extending along the bottom of said lower portion to form a lower edge of said lower portion; and a photoluminescent strip extending laterally across said upper portion near said curved convex surface, said strip having a predetermined height less than the predetennined height of said upper portion and becoming luminous when the ambient light is extinguished;

said non-luminescent upper portion and said photoluminescent strip being made from extrudable materials, and said non-luminescent upper portion and said photoluminescent strip having been coextruded and molecularly bonded to one another to form an integrally formed product.

2. A wall cove base comprising:

a non-luminescent flat member having an upper portion and a lower gauging portion, said upper portion having a predetermined height, and said upper portion and said lower portion gauging portion having a generally planar front surface and a substantially continuous rear surface for being attached to a wall surface, said lower gauging portion having a height and thickness less than the height and thickness of said upper portion, said front surface and said rear surface each having an upper part of said front surface, a transition zone including a bottom wall on said upper portion which tapers downwardly and forwardly toward said front planar surface, said bottom wall intersecting said front planar surface and forming a tip which points substantially downwardly; and a photoluminescent strip extending laterally across the front surface of said upper portion in close proximity to said convex, curved surface, said photoluminescent strip having, a predetermined height which is less than the predetermined height of said upper portion, and said photoluminescent strip becoming luminous when the ambient light is extinguished;

said non-luminescent upper portion and said photoluminescent strip being made from extrudable materials, said non-luminescent upper portion and said photoluminescent strip having been coextruded and molecularly bonded to one another to form an integrally formed product.

* * * * *